United States Patent [19]

Hasegawa et al.

[11] 3,931,938

[45] Jan. 13, 1976

[54] METHOD AND APPARATUS FOR WINDING YARN INTO YARN PACKAGE

[75] Inventors: Katsumi Hasegawa, Otsu; Ichiro Kumo, Shiga; Chikayasu Yamazaki; Minoru Okabayashi, both of Kyoto; Takao Nakayama, Otsu; Masahiro Oshiyama, Shizuoka, all of Japan

[73] Assignee: Toray Industries, Inc., Tokyo, Japan

[22] Filed: Mar. 18, 1974

[21] Appl. No.: 451,914

[52] U.S. Cl. ..... 242/45

[51] Int. Cl.[2] ..... B65H 59/38

[58] Field of Search ..... 242/45, 43, 75.5, 75.51, 242/75.52; 318/6

[56] References Cited

UNITED STATES PATENTS

| | | | |
|---|---|---|---|
| 3,048,343 | 8/1962 | Keith | 242/45 |
| 3,537,660 | 11/1970 | Schippers et al. | 242/45 |
| 3,638,873 | 2/1972 | Cole | 242/45 |
| 3,670,975 | 6/1972 | Tomimatsu | 242/45 |

*Primary Examiner*—Stanley N. Gilreath

[57] ABSTRACT

Yarn is continuously supplied at constant speed to a winding apparatus having a positively driven winding spindle. The tension of the yarn is periodically detected by a force transducer located at an edge of the area covered by the traverse motion of the yarn. The force transducer generates an electrical signal related to tension. The electrical signal is compared with a pre-set desired value and the difference is fed into a controller which acts upon a regulator for varying the speed of rotation of the winding spindle. The regulator varies the speed of rotation of the winding spindle according to the output of the controller, keeping the yarn tension at the desired value throughout the winding operation.

18 Claims, 14 Drawing Figures

METHOD AND APPARATUS FOR WINDING YARN INTO YARN PACKAGE

BRIEF SUMMARY OF THE INVENTION

The present invention relates to a method and apparatus for winding yarn into a yarn package. The yarn may be supplied at a constant speed, preferably at a relatively high speed and under low tension, by a spindle drive type winding apparatus.

Technological advancements have been remarkable in recent years in the fiber industries. Especially, in order to obtain high productivity, the speed of formation of yarn has been remarkably increased. This has required radically improved high speed winding apparatus.

Also, the sizes of yarn packages have been substantially increased. Accordingly, the weight of the yarn package has also increased. Winding yarn at a speed of several thousand meters per minute into a yarn package weighing more than 10 kg has become a regular occurrence.

In a yarn winding operation with the yarn support at a constant speed by a spindle drive type winding apparatus, it becomes necessary, as the winding proceeds, gradually to decrease the speed of rotation of the winding spindle as the diameter of a package increases, to maintain the winding speed constant. Otherwise, the tension of the yarn gradually increases and the package is non-uniform. If the tension of the yarn increases enough, the yarn layer collapses, eventually making it impossible to wind the yarn.

In regard to keeping the winding speed constant, the following technologies have been known.

Referring to the drawings, tension detectors shown in FIGS. 1 and 2 show the tension of the yarn being detected during winding. The rotation of the winding spindle is controlled to provide the desired value of this detected tension.

The tension detector as shown in FIG. 1 comprises one movable guide 3 between two fixed guides 1, 2. The movable guide 3 moves back and forth, as shown by the arrow, in accordance with variations of the tension of yarn Y.

The tension detector shown in FIG. 2 comprises a crank arm swingable about a pivot 4. A guide roll 6 is rotatably mounted at one end of arm 5. As will be apparent from FIG. 2, the arm 5 swings against the tension of a spring 7 mounted near the end of arm 4, and varies in accordance with the tension of yarn Y.

In each of the aforesaid tension detectors, displacement of a movable member (movable guide 2 or arm 5) is converted to an electrical signal, which is used as an electrical input to a means for controlling the speed of rotation of the winding spindle.

However, these prior art procedures have had many drawbacks, as will be mentioned hereinbelow, and the application of these technologies to very high speed winding of yarn, especially at low tension, has been very difficult.

A few of the reasons for this will be explained as follows: Because the yarn always runs in contact with a tension detector, the frictional resistance is very great. Such frictional resistance is a source of damage to the yarn, abrasion of the guides and fusion of the yarn on the guides by generation of heat. This eventually causes fluctuation of physical properties along the length of the yarn.

Because the tension detector has a mechanically movable member, there is a delay in response, because of the mass of such member. When a tension detector as shown in FIG. 2 is used an expensive and complicated non-linear control system becomes necessary because the rotating angle of the arm 6 is not proportional to the tension of the yarn.

Accordingly, an important object of the present invention is to provide a method and apparatus for winding yarn which is supplied at a constant speed, especially when the yarn is supplied at a relatively high speed and under low tension into a large package.

Other objects of the present invention will become apparent from the following explanation, and from the drawings.

DRAWINGS

FIG. 7 (B) is a vector diagram showing details of the force relations of the diagram of FIG. 7 (A).

DETAILED DESCRIPTION OF THE INVENTION

Hereinbelow, a few embodiments of the present invention will be explained. However, the scope of the present invention is not limited to these embodiments, which are intended to be illustrative.

Figure 3:
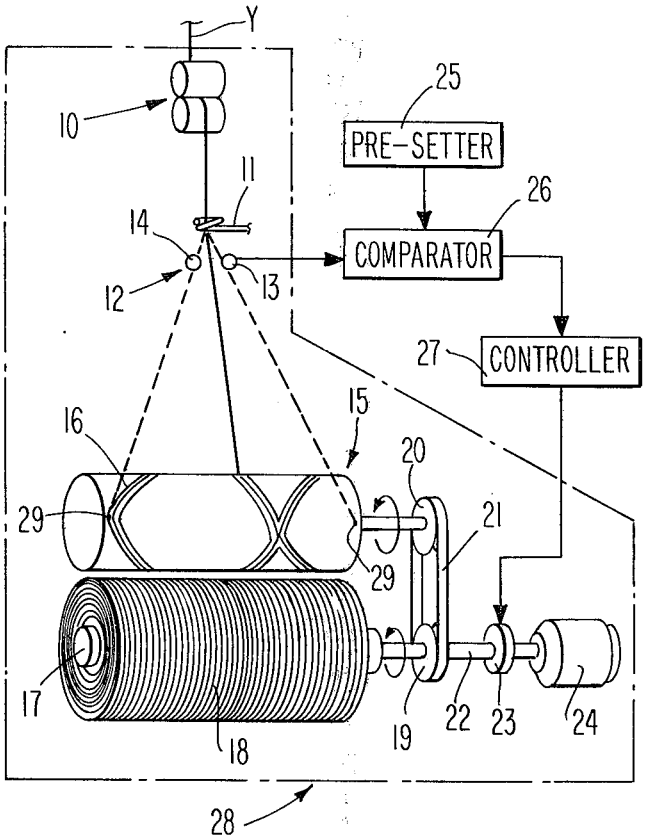
FIG. 3 is a schematic diagram showing one form of yarn winder comprising an embodiment of the present invention.

FIG. 3 shows an embodiment of the present invention in which a yarn Y is supplied at a constant speed by a pair of feed rollers 10, 10. The yarn Y passes through a fixed guide 11 and becomes engaged with a groove 16 of a traverse roll 15. The yarn Y is given a traverse motion between the traverse roll 15 and the fixed guide 11, as indicated by the dash lines in FIG. 3. The yarn Y is wound on bobbin 17 to form a package 18.

A winding spindle 22 is driven by a motor 24. The speed of rotation of the winding spindle 22 may be varied by a speed regulator 23. As will be apparent from FIG. 3, the bobbin 17 and the traverse roll 15 are driven in the same direction. The traverse roll 15 is connected to the winding spindle 22 by pulleys 19 and 20 and a belt 21 running around and between these pulleys 19 and 20.

In the area through which the yarn Y is traversed, as shown by dash lines in FIG. 3, guides 13 and 14 of a force transducer 12, which is a tension detector, are provided. At each extremity of the area through which the yarn Y is traversed, yarn Y periodically contacts the guides 13 and 14, and electrical signals are thereby generated in the force transducer 12 which are proportional to the period of the traverse motion of the yarn to the tension of the yarn.

In the embodiment of FIG. 3, an electrical signal relating only to tension is used. This electrical signal is compared with a signal of a predetermined value of constant magnitude, which may be inserted as an input corresponding to a desired value of tension by a "presetter" 25 into a comparator 26. The difference between the measured and the preset electrical signals is forwarded to a controller 27, which in turn regulates a speed regulator 23 on the basis of the difference between the measured and preset electrical signals. The speed regulator 23 varies the speed of rotation of the winding spindle 22 in response to the output signal of the controller 27.

The controller 27 gradually decreases the speed of rotation of the winding spindle 22 as winding of the yarn Y proceeds, to keep the winding speed constant. Accordingly, the yarn Y is wound up from beginning to end under a predetermined constant tension. In FIG. 3, the area 28 collectively shows an apparatus which is appropriate for winding the yarn and the points 29 indicate the extremities of the traverse motion of the yarn.

Figure 2:
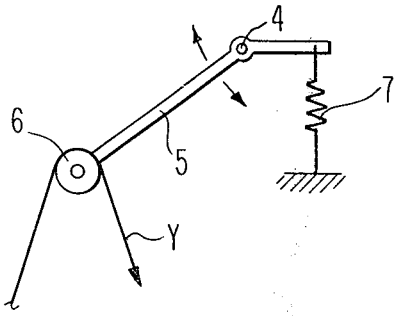
PRIOR ART Fig. 2
FIGS. 1 and 2 are schematic diagrams of tension detectors for explaining the prior art.
Figure 1:
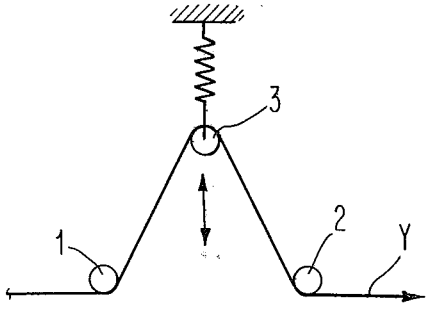
PRIOR ART Fig. 1
Figure 4:
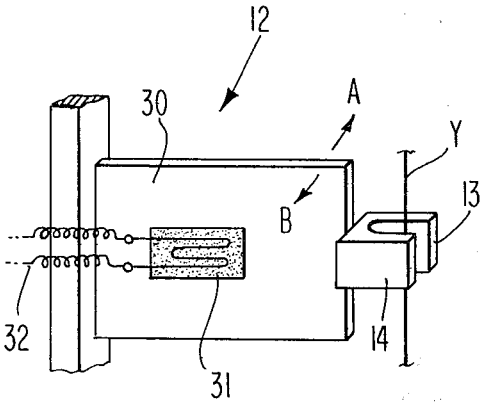
FIG. 4 is a fragmentary perspective diagrammatic view showing a force transducer of the type utilized in a winder of the type illustrated in FIG. 3.

The force transducer 12 mounted on the frame of the apparatus for winding the yarn has a structure of the type illustrated by way of example in FIG. 4. At the edge of an elastic plate 30 of the force transducer 12, guides 13 and 14 are provided. On one surface of the elastic plate 30, a semi-conductor strain gauge 31 is firmly adhered. The signal corresponding to variation of the resistance of this semi-conductor strain gauge 31 is taken out to the outside by a lead wire 32. Such strain gauges are well known per se, and have the ability to measure small forces with great sensitivity. The elastic plate 30 is usually made of a material having a large elasticity coefficient having excellent fatigue resistance, for example, steel or phosphorus bronze. As long as the extension and compression motion of the elastic plate 30 is carried out within the elastic limits thereof, the amplitude A in FIG. 5 is proportional to the tension of the yarn Y.

As will be apparent from FIGS. 3 and 4, when the traversing yarn Y contacts the guide 13 at one extremity of the traverse motion, the elastic plate 30 is bent in the direction of the arrow A in FIG. 4. Therefore, a tension force develops in the semi-conductor strain gauge 31. On the contrary, when the traversing yarn Y contacts the guide 14 at the other extremity of the traverse motion, the elastic plate 30 is bent in the direction of the arrow B. Therefore, a compression force develops in the semi-conductor strain gauge 31 shown in FIG. 4.

Accordingly, forces of tension and compression are periodically imparted by the traversing yarn Y to the semi-conductor strain gauge 31. Accordingly, the electrical signal obtained from the force transducer 12 is as shown in FIG. 5.

Figure 5:
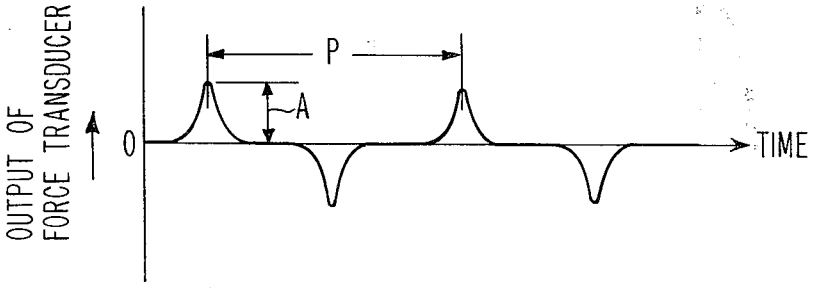
FIG. 5 is a graph showing the output signal of a force transducer plotted against time.

It is apparent that the time P in FIG. 5 shows the period of time elapsing for each traverse motion of the yarn Y.

It is possible to eliminate either one of the guides 13 or 14 of the force transducer 12. The output signal as would be analogized from FIG. 5 would be such that its peak appears only above the zero level. Instead of the semi-conductor strain gauge 31, a wire strain gauge may be used.

Figure 6:
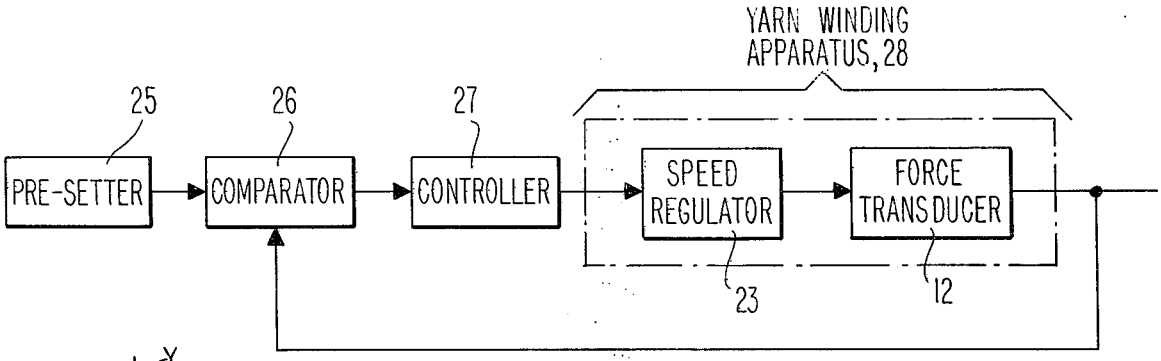
FIG. 6 is a block diagram of the embodiment of the winder appearing in FIG. 3.

The embodiment referred to in FIGS. 3 – 5 is also explained with reference to the diagram appearing in FIG. 6.

The desired value of the tension generated by presetter 25 is compared by a comparator 26 with a value of an output signal of the force transducer 12 of the apparatus for winding a yarn 28. The difference of signals between desired value of the tension and the value of the output signal of the force transducer 12 is forwarded to a controller 27. The controller 27 actuates a speed regulator 23 of the winding apparatus 28, based on the difference between the signals. The speed of rotation of the winding spindle is varied by the speed regulator 23.

Figure 13:
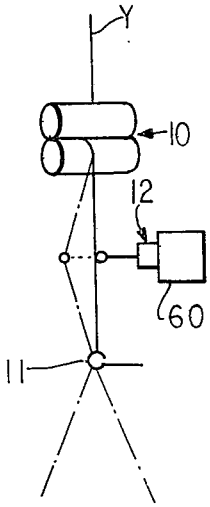
FIG. 13 is a schematic diagram showing a vibrator arranged to cause a force transducer to periodically contact and deflect a yarn.

When either one of the guides 13 or 14 of the force transducer 12 is eliminated as mentioned above, and the force transducer 12 is located between the feed rollers 10 and the fixed guide 11, and said one guide is caused by a vibrator 60 to contact the yarn Y periodically as shown in FIG. 13, it is also possible to achieve some of the objects of the present invention. However, in that case, it is not possible to detect the period of the traverse motion of the yarn Y. The vibration period of the vibrator 60 is such that the yarn travel during each period between successive contacts of the force transducer with the yarn does not exceed the distance beyond which a constant winding tension could not be maintained. This vibration period depends upon the kind of yarn used, yarn speed, etcetera.

Also, this embodiment may be applied readily to a winding apparatus in which the traverse roll and the bobbin are driven independently, that is, the number of traverse motion per unit of time is kept constant during the entire winding operation and the speed of rotation of the bobbin is gradually decreased as the winding proceeds. In such a case, the periodic signal is detected from variation of rotation of the bobbin instead of traverse motion.

As will be apparent from the foregoing explanation, it is apparent that this embodiment is free from the drawbacks of the prior art explained hereinabove because the yarn contacts the force transducer only for a moment, and periodically.

Figure 7A:
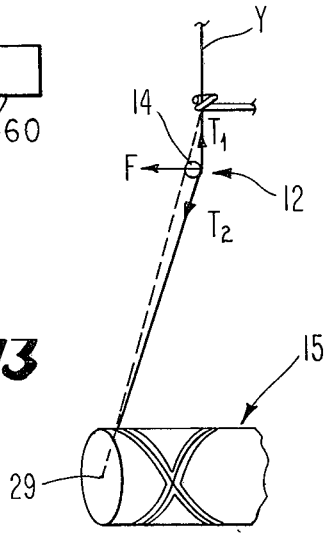
FIG. 7 (A) is a diagrammatic view showing the principle according to which it is possible to measure yarn tension with a force transducer by deflecting the yarn therewith.
Figure 7B:
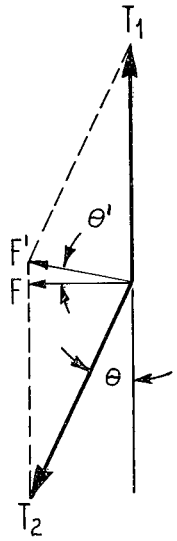

FIGS. 7 (A) and 7 (B) show essential portions of the embodiment appearing in FIG. 3. Now, $\theta$ is the very small angle made by excursion of the yarn Y after it passes through the fixed guide 11 and the yarn Y after it passes through the guide 14 of the force transducer. Tensions acting on the yarn Y are called $T_1$ and $T_2$, with the point where the yarn Y contacts the guide 14 of the force transducer 12 as the boundary. Then, the force F with which the yarn Y tries to press the guide 14, is expressed by the equation $$F^2 = (T_1^2 + T_2^2 - 2T_1 \cdot T_2 \cdot \cos\theta) \times \cos^2\theta' \qquad (1)$$

When the friction between the guide 14 and the yarn Y is small, $T_1 = T_2$, $\theta' = \theta/2$, therefore, the equation (1) becomes $$F = T_1 \sqrt{2(1 - \cos\theta)} \times \cos(\theta/2) \quad (2)$$

Accordingly, the force acting on the guide 14 and the tension of the yarn are basically proportional.

Although as explained the first embodiment gives excellent results, the gain of the controller 27 is constant even when the diameter of the package 18 increases. Because of that, when the diameter (and the weight) of the package 18 increases, a "hunting phenomenon" sometimes occurs.

Figure 8:
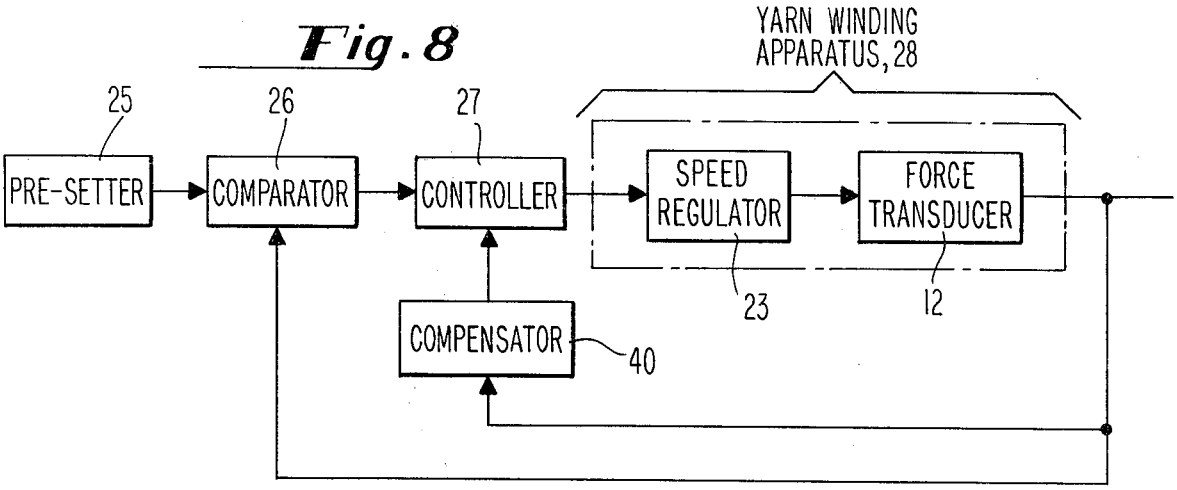
FIG. 8 is a block diagram showing another embodiment of the present invention.

Another embodiment of the present invention, shown in FIG. 8, positively improves the first embodiment; it recognizes that the period of the traverse motion of the yarn gradually lengthens as the diameter of the package increases.

Again, returning to FIG. 3, as the diameter of the package 18 increases, the speed of rotation of the winding spindle 22 gradually decreases; the speed of rotation of the traverse roll 15 connected to the winding spindle gradually decreases as well. Accordingly, the period of traverse motion gradually becomes large.

A difference between the embodiment shown in FIG. 8 is compared to that shown in FIG. 3 resides as establishment of a compensator 40 gradually decreasing the gain of the controller 27 as the diameter of the package increases between the force transducer 12 and the controller 27. In FIG. 3, of the electrical signals obtained from the force transducer 12, only an electrical signal relating to the tension of the yarn (shown by the mark A in FIG. 5) is used. However, in FIG. 8, an electrical signal indicating the period of the traverse motion (shown by the mark P in FIG. 5) is utilized additionally. By establishing such compensator 40, the gain of the controller 27 is always maintained at a proper value in accordance with the magnitude of the load. Therefore, the "hunting phenomenon" ceases to occur.

Figure 9:
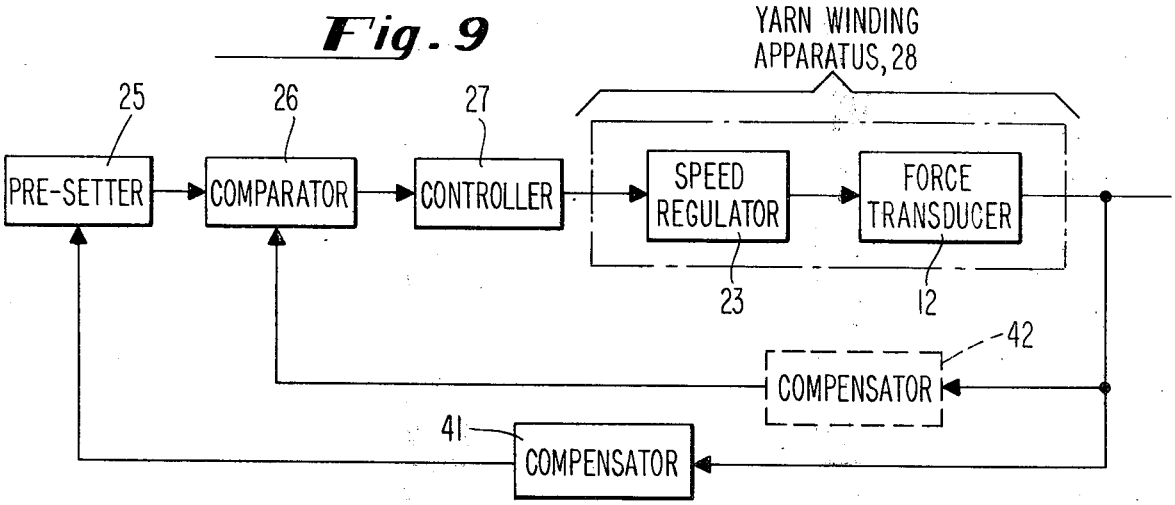
FIG. 9 is a block diagram showing still another embodiment of the present invention.

Yet another embodiment shown in FIG. 9 adds to the enbodiment of FIG. 3 a compensator 41 gradually decreasing the desired value of tension as the diameter of the package increases. This is suitable when it is desired gradually to decrease the tension of the yarn as the diameter of the package increases. When, instead of this compensator 41, a compensator 42 is provided between the force transducer 12 and the comparator 26, having exactly the same function as this compensator 41, it is possible to achieve about the same effect. However, in this latter embodiment, such compensator 40 as provided in the preceding embodiment, is not set up. Accordingly, this embodiment has no effectiveness in preventing hunting.

Figure 10:
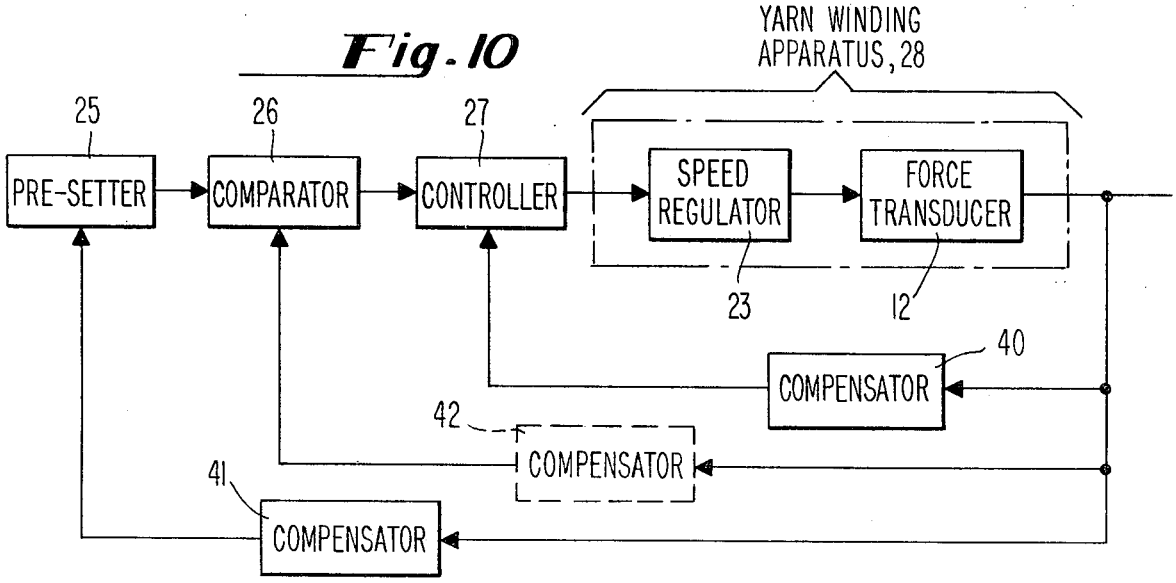
FIG. 10 is a block diagram showing still another embodiment of the present invention.
Figure 11:
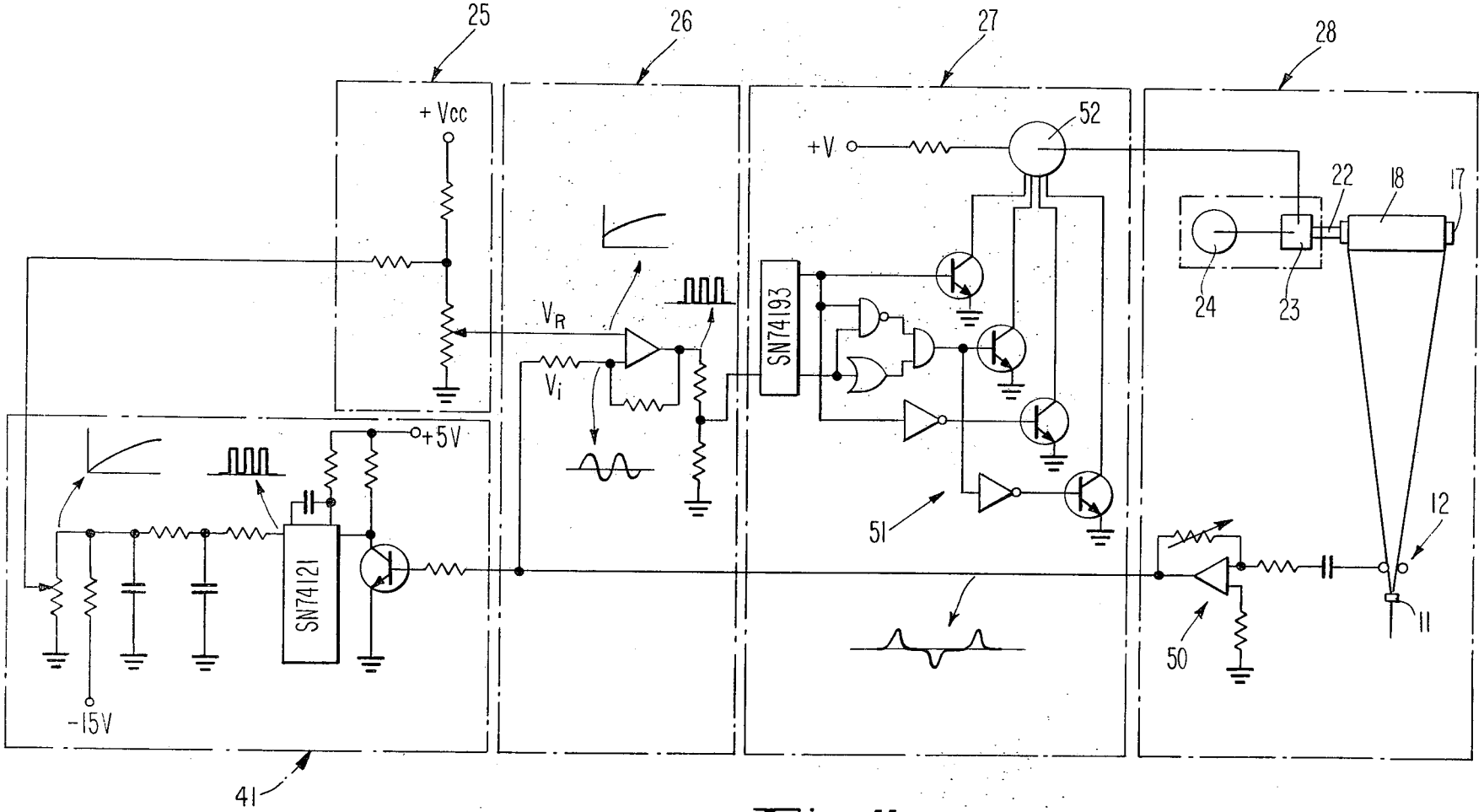
FIG. 11 is a diagram of the electric circuit of the embodiment shown in FIG. 10.

Yet another embodiment is shown in FIG. 10; see also the said specific electric circuit shown in FIG. 11.

In FIG. 11, in order to facilitate the understanding of the following explanation, a wavy signal is shown at each portion. A signal obtained from a force transducer 12 is amplified by an amplifier 50. This amplified signal is forwarded via a compensator 41 to a presetting device 25 as an input. The compensator 41 converts the period of the traverse motion of a yarn Y to a rectangular wave having a width representing a constant time. Further, converting the wave to an analogous amount to prepare an input of the pre-setting device 25, and dividing the constant voltage ($V_{cc}$) by a variable resistance, the initial value of a standard signal of the tension is set up. To this initial value, the signal of the compensator 41 is added in order to create a standard signal for the tension ($V_R$).

On the other hand, the signal ($V_i$) from the force transducer 12 is forwarded to a comparator 26 as an input. The comparator 26 generates a pulse signal as an output when ($V_i$) is larger than ($V_R$).

When the relationship between the frequency of generation of the pulse signal of the comparator 26 and the diameter of a package 18 is stated, it works out as follows. Specifically, as the diameter of the package 18 increases, the period of the traverse motion of the yarn Y increases. Therefore, the frequency of ($V_i$), becoming larger than ($V_R$) per unit time, gradually decreases. Accordingly, the number of pulse signals generated by the comparator 26 decreases in a manner inversely proportional to the diameter of the package 18. This is exactly the same as the function of the compensator 40 in FIG. 10 and the gain of the controller 27 gradually decreases as the diameter of the package 18 increases. From the above description, it is clear that the compensator 40 is unnecessary and is not shown in FIG. 11.

The output of the comparator 26 drives a pulse motor driver 51 of the controller 27 to rotate a pulse motor 52. The pulse motor 52 drives a speed regulator 23 to control the number of rotations of the winding spindle 22.

In FIG. 11, the amplifier 50 of the force transducer 12 is depicted as if it were a part of the apparatus proper for winding a yarn 28. However, it is conventional that such an electric system is provided separately from a machine system which is about the same as other electrical systems.

In the apparatus for properly winding a yarn, an indefinite vibration is generated by transmission of power, the inertia of a portion causing a reciprocating motion, variation of load, and eccentricity of rotating portions. To the force transducer mounted on a part of the apparatus which is proper for winding a yarn, the disturbing influence of such vibration is imparted. Accordingly, a signal obtained from the force transducer becomes the sum of a normal signal and of an abnormal signal generated by said outer disturbance (noise). Because the outer disturbance markedly lowers the S/N ratio of the electrical system, it is preferable to eliminate the same as much as possible or to cause the influence not to appear by special treatment of the signal.

Figure 12:
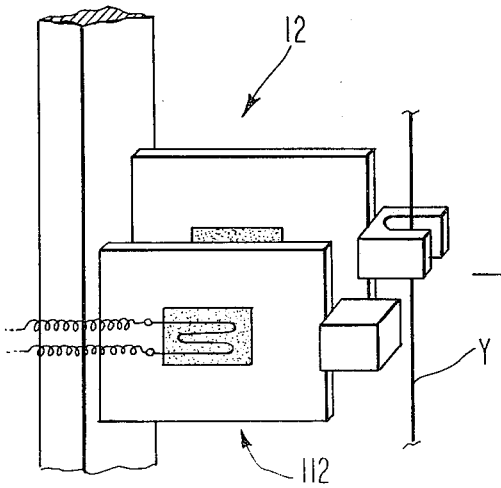
FIG. 12 is a fragmentary perspective diagrammatic view of another embodiment of a force transducer which is different from the force transducer explained in connection with FIG. 4.

A force transducer shown in FIG. 12 is obtained as a countermeasure for improving said signal-to-noise (S/N) ratio. Specifically, in the vicinity of the force transducer 12, a dummy 112, which is exactly the same as this force transducer, is provided. This dummy has about the same vibration characteristics as that of the force transducer. Accordingly, when a signal which is a difference between the output signal of the force transducer 12 and the output signal of the dummy 112 is to be taken out, it is possible simply to eliminate the influence of this by vibration of the winding apparatus proper. By this, the detecting precision advances drastically and it becomes unnecessary to impart a noise countermeasure to an electric system treating the detected signal.

The following is claimed:

1. A method for winding a yarn into a yarn package by use of a winding apparatus which comprises the steps of:

1. supplying the yarn to the winding apparatus at a substantially constant speed,
2. setting a desired value of the tension,
3. reciprocally traversing the yarn longitudinally along said package, 4. contacting the yarn with a force transducer at each extremety of the yarn traverse stroke and disengaging the yarn from the force transducer when the yarn is between the extreme ends of the traverse stroke.
5. detecting the tension of the yarn with the force transducer at each extremity of the yarn traverse stroke during the time the yarn is contacting said transducer,
6. comparing the magnitude of the detected tension with that of the desired value,
7. obtaining the difference in magnitude between the detected tension and the desired value as a controlling value, and
8. controlling the circumferential speed of the yarn package according to the controlling value.

2. A method as claimed in claim 1, wherein said desired value is constant.

3. A method as claimed in claim 1, wherein said desired value is gradually decreased in proportion to the growth of the yarn package.

4. An apparatus for winding a yarn into a yarn package comprising:
1. means for supplying the yarn at a constant speed,
2. a winding device for driving a winding bobbin for winding the yarn,
3. a yarn traverser for imparting a traverse motion to the yarn, the yarn traverser being located upstream of the winding spindle,
4. a force transducer for producing an electrical signal indicative of the tension of the traversing yarn and means for periodically making contact of said yarn with said transducer and then disengaging it therefrom, at each extremity of the yarn traverse, the force transducer being placed upstream of the yarn traverser,
5. a regulator for regulating the speed of rotation of the winding spindle,
6. a setting device for producing an electrical signal indicative of the desired tension,
7. a comparator for comparing the force transducer electrical signal with the setting device electrical signal and producing an error signal indicative of the difference of said signals, the comparator being connected to the force transducer and the setting device, and
8. a controller actuated by the error signal, for controlling the speed regulator in response to said error signal, the controller being connected to the comparator and the regulator.

5. An apparatus as claimed in claim 4, wherein
1. said traverser is provided with means for relating its movement to rotation of the winding spindle, and
2. said controller is provided with means for varying its gain in accordance with the error signal.

6. An apparatus as claimed in claim 5, wherein a compensator for decreasing the gain of the controller in accordance with a decrease in speed of the traverse motion of the yarn is placed between the force transducer and the controller.

7. An apparatus as claimed in claim 5, wherein a compensator for decreasing the desired tension in accordance with a decrease in speed of the transverse motion of the yarn is placed between the force transducer and the setting device.

8. An apparatus as claimed in claim 5, wherein a compensator for decreasing the output of the comparator in accordance with a decrease in speed of the traverse motion of the yarn is placed between the force transducer and the comparator.

9. An apparatus as claimed in claim 6, wherein a compensator for decreasing the output of the comparator in accordance with a decrease in speed of the traverse motion of the yarn is placed between the force transducer and the comparator.

10. An apparatus as claimed in claim 5, wherein a compensator for decreasing the desired tension in accordance with a decrease in speed of the traverse motion of the yarn is placed between the force transducer and the setting device.

11. An apparatus as claimed in claim 4, wherein said force transducer is composed of a detecting element and a dummy element having vibration characteristics substantially equal to that of the detecting element, both of them being electrically connected.

12. An apparatus as claimed in claim 11, wherein
1. said traverser is provided with means for relating its movement to rotation of the winding spindle, and
2. said controller is provided with means for varying its gain in accordance with the error signal.

13. An apparatus as claimed in claim 12, wherein a compensator for decreasing the gain of the controller in accordance with a decrease in speed of the traverse motion of the yarn is placed between the force transducer and the controller.

14. An apparatus as claimed in claim 12, wherein a compensator for decreasing the output of the comparator in accordance with a decrease in speed of the traverse motion of the yarn is placed between the force transducer and the setting device.

15. An apparatus as claimed in claim 12, wherein a compensator for decreasing the output of the comparator in accordance with a decrease in speed of the traverse motion of the yarn is placed between the force transducer and the comparator.

16. An apparatus as claimed in claim 12, wherein a compensator for decreasing the desired tension in accordance with a decrease in speed of the period of the traverse motion of the yarn is placed between the force transducer and the setting device.

17. An apparatus for winding a yarn into a yarn package comprising:
1. means for supplying yarn at a constant speed,
2. a winding spindle for driving a winding bobbin for winding the yarn,
3. a force transducer for producing an electrical signal indicative of the tension of the yarn, being located between the yarn supplier and the winding spindle,
4. a vibrator for periodically causing the force transducer to make contact with and deflect the yarn and then to disengage it therefrom, the vibrator being connected to the force transducer,
5. a regulator for regulating the speed of rotation of the winding spindle,
6. setting means for producing an electrical signal indicative of the desired yarn tension,
7. a comparator for comparing the force transducer electrical signal with the electrical signal indicative of the yarn tension and producing an error signal indicative of the difference of said signals, the comparator being connected to the force transducer and said setting means, and 8. a controller actuated by the error signal for controlling the speed regulator in response to the error signal, the controller being connected to the comparator and the regulator.

18. An apparatus as claimed in claim 13, wherein a compensator for decreasing the output of the comparator in accordance with a decrease in speed of the transverse motion of the yarn is placed between the force transducer and the comparator.

* * * * *